US005452061A

United States Patent [19]

Kojima et al.

[11] Patent Number: 5,452,061

[45] Date of Patent: Sep. 19, 1995

[54] IMAGE FORMATION APPARATUS

[75] Inventors: Narihito Kojima; Hiroshi Nagame; Hiroshi Ikuno, all of Numazu, Japan

[73] Assignee: Ricoh Company, Ltd., Tokyo, Japan

[21] Appl. No.: 160,144

[22] Filed: Dec. 2, 1993

[30] Foreign Application Priority Data

Dec. 3, 1992 [JP] Japan ..... 4-350438

[51] Int. Cl.[6] ..... G03G 15/02

[52] U.S. Cl. ..... 355/219; 355/221

[58] Field of Search ..... 355/219, 221, 222, 223, 355/225, 226

[56] References Cited

U.S. PATENT DOCUMENTS

| | | | |
|---|---|---|---|
| 3,918,971 | 11/1975 | Zweig | 355/219 X |
| 3,950,680 | 4/1976 | Michaels et al. | 355/219 X |
| 4,045,217 | 8/1977 | Fujimura et al. | 355/219 X |
| 4,272,183 | 6/1981 | Maese et al. | 355/219 |
| 4,351,604 | 9/1982 | Karasawa et al. | 355/326 R |
| 4,443,095 | 4/1984 | Tsushima et al. | 355/226 X |
| 4,515,462 | 5/1985 | Yoneda | 355/226 X |
| 4,593,989 | 6/1986 | Fujiwara et al. | 355/219 X |
| 4,811,045 | 3/1989 | Matsushita et al. | 355/219 |
| 5,147,751 | 9/1992 | Kojima et al. . | |
| 5,323,215 | 6/1994 | Ohtaka et al. | 355/219 X |

*Primary Examiner*—Matthew S. Smith

*Attorney, Agent, or Firm*—Oblon, Spivak, McClelland, Maier & Neustadt

[57] ABSTRACT

An electrophotographic image formation apparatus using a photoconductor which is composed of a substrate, a photoconductive layer provided on the substrate, and a protective layer formed directly or via an intermediate layer on the photoconductive layer and capable of performing an electrophotographic process including the steps of conducting a first charging for uniformly charging the surface of the photoconductor, exposing the charged surface of the photoconductor to light images to form latent electrostatic images corresponding to the light images, developing the latent electrostatic images to toner images, transferring the toner images to a transfer sheet, cleaning the surface of the photoconductor to remove residual toners therefrom, and fixing the toner images to the transfer sheet, includes a charger for charging the photoconductor with a polarity opposite to that of the charge applied in the step of the first charging prior to the step of the first charging.

4 Claims, 5 Drawing Sheets

IMAGE FORMATION APPARATUS

BACKGROUND OF THE INVENTION

1. Field of the Invention

The present invention relates to an electrophotographic image formation apparats capable of forming high quality images stably for an extended period of time, using an electrophotographic photoconductor comprising a substrate, a photoconductive layer provided on the substrate, and a protective layer formed directly or via an intermediate layer on the photoconductive layer.

2. Discussion of Background

Conventionally varieties of electrophotographic image formation apparatus have been known. A representative example of such an electrophotographic image formation apparatus is illustrated in FIG. 10.

The operation of the electrophotographic image formation apparatus shown in FIG. 10 is as follows:

A drum-shaped photoconductor 1 is rotated in the direction of the arrow, so that the surface of the photoconductor 1 is uniformly charged by a charger 2. A light beam which has been modulated in accordance with image signals to be recorded is applied to the charged surface of the photoconductor 1 by an exposure unit 3, so that latent electrostatic images corresponding to the image signals are formed on the surface of the photoconductor 1. The thus formed latent electrostatic images are then developed to visible toner images by a development unit 4. The toner images are then transferred to a copy paper 9 by an image transfer charger 5. The toner-image-bearing copy paper 9 is separated from the photoconductor 1, and the toner images are fixed to the copy paper 9 by an image fixing unit 10, whereby a hard copy is obtained.

After the above image transfer, the toner remaining on the surface of the photoconductor 1 is removed by a cleaning unit 7, and the residual charges on the surface of the photoconductor 1 are quenched by a quenching lamp 8. Thus a series of copy making steps is completed.

Various types of photoconductors are in general use as the above-mentioned photoconductor, for instance, a photoconductor comprising an electroconductive substrate, and a photoconductive layer formed thereon, which comprises as the main component selenium or a selenium alloy, for example, Se—As, Se—Te, and Se—As—Te; a photoconductor comprising an inorganic photoconductive material such as zinc oxide or cadmium sulfide, and a binder agent in which the inorganic photoconductive material is dispersed; a photoconductor comprising an organic photoconductive material (OPC) such as poly-N-vinylcarbazole or azo pigments; and a photoconductor comprising an amorphous silicon.

Fundamental characteristics required for the photoconductor 1 are the following characteristics (A) to (D):

(A) chargeable in the dark to an appropriate potential;

(B) minimum dissipation of charges in the dark;

(C) quick dissipation of charges when exposed to light; and (D) having sufficient mechanical and chemical resistances for practical use in electrophotographic process.

In view of the above characteristics (A) to (D) required for the photoconductor 1, the above-mentioned amorphous-silicon based photoconductor has high surface strength, high mechanical durability (for instance, in the contact portions in the development unit, image transfer unit, and cleaning unit), and excellent photosensitivity. However, the amorphous-silicon based photoconductor has the shortcomings that the chargeability thereof is low, the production cost is high, the resistance to chemicals, in particular, to ozone ($O_3$), $NO_x$, and composite materials formed from ozone ($O_3$), $NO_x$, and other materials contained in the atmosphere, is weak, and the surface resistance of the photoconductor decreases by the moisture in the air, which causes the formation of abnormal images, called "image flow".

The above-mentioned Se-based photoconductor has excellent photosensitivity and chargeability and has been conventionally most widely used. However, it has the shortcomings that the surface of the photoconductor is easily scratched and tends to produces images with non-printed stripes or black-striped images.

Recently organic photoconductors (OPC) have been widely used because of the advantages over other photoconductors that the production cost is low, almost no pollution problems are caused by the production thereof, and there is more freedom in the designing thereof in comparison with other photoconductors. However, organic photoconductors have the shortcomings that the surface hardness thereof is low because they are made of organic materials, and therefore the surface thereof is easily abraded, so that the potential of the charged surface is decreased by such abrasion and images with non-printed stripes or black-striped images are formed.

The provision of a protective layer directly or via an intermediate layer on the photoconductive layer has been proposed to eliminate the shortcomings of the Se-based photoconductor and organic photoconductors with respect to the mechanical durability thereof, thereby improving the durability to the mechanical stress or load applied thereto in or outside a copying machine.

For instance, an organic film is provided on the surface of a photoconductor in Japanese Patent Publication 38-015466, an inorganic oxide is provided on the surface of a photoconductor in Japanese Patent Publication 43-014517, an adhesive layer is provided on the surface of a photoconductor, and an insulating layer is overlaid on the adhesive layer in Japanese Patent Publication 43-027591, an amorphous silicon layer (a-Si layer), an a-Si:N:H layer, or a-Si:O:H layer is overlaid on the surface of a photoconductor by the plasma CVD method, or by the light CVD method in Japanese Laid-Open Patent Applications 57-179859 and 59-058437.

Varieties of films with high hardness consisting of carbon or comprising carbon as the main component, which are referred to as a-C:H film, an amorphous carbon film or a diamond-like carbon film, have recently been used as protective layers for photoconductors.

For instance, a protective layer composed of amorphous carbon or hard carbon is provided on the surface of a photoconductive layer in Japanese Laid-Open Patent Application 60-249155; a protective layer composed of a diamond-like carbon is provided on the top surface of a photoconductor in Japanese Laid-Open Patent Application 61-255352; an insulating layer with high hardness comprising carbon as the main component is provided on a photoconductive layer in Japanese Laid-Open Patent Application 61-264355; a protective layer produced by glow discharge, which is composed of an amorphous hydrocarbon film and contains at least atoms such as a nitrogen atom, an oxygen atom, a halogen atom, and an alkali metal atom, is provided on an organic photoconductive layer in Japanese Laid-Open Patent Applications 63-220166, 63-220167, 63-220168, and 63-220169.

Se-based photoconductors and organic photoconductors, which are improved with respect to the surface hardness thereof and have excellent resistance to abrasion, have been available at a relatively low cost by the above-mentioned methods.

However, when these photoconductors are repeatedly used in the electrophotographic process, the residual potential of the photoconductors, which is the potential at a portion of the surface of the photoconductors which have been exposed to light after a first charging, tends to increase temporarily or with time over a long period of time, although the durability to the abrasion is in fact increased, so that abnormal images are produced. The result is that the overall durability of these photoconductors cannot be improved by any of the above-mentioned methods.

SUMMARY OF THE INVENTION

It is therefore an object of the present invention to provide an electrophotographic image formation apparatus capable of forming high quality images stably for an extended period of time by use of an electrophotographic photoconductor comprising a substrate, a photoconductive layer provided on the substrate, and a protective layer formed directly or via an intermediate layer on the photoconductive layer.

This object of the present invention can be achieved by an electrophotographic image formation apparatus which comprises a photoconductor comprising a substrate, a photoconductive layer provided on the substrate, and a protective layer formed directly or via an intermediate layer on the photoconductive layer and is capable of performing an electrophotographic process comprising the steps of conducting a first charging for uniformly charging the surface of the photoconductor, exposing the charged surface of the photoconductor to light images to form latent electrostatic images corresponding to the light images, developing the latent electrostatic images to toner images, transferring the toner images to a transfer sheet, cleaning the surface of the photoconductor to remove residual toners therefrom, and fixing the toner images to the transfer sheet, the electrophotographic image formation apparatus further comprising a charger for charging the photoconductor with a polarity opposite to that of the charge applied in the step of the first charging step prior to the step of the first charging.

For achieving the above object of the present invention, the photoconductive layer of the photoconductor may be an organic photoconductive layer and the protective layer may be a thin layer comprising carbon.

Furthermore, for achieving the above object of the present invention, the charger for charging the photoconductor with a polarity opposite to that of the charge applied in the step of the first charging prior to the step of the first charging may be an A.C. charger biased so as to be capable of charging the photoconductor with a polarity opposite to that of the charge applied in the step of the first charging.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The inventors of the present invention have analyzed the mechanism of the elevation of the residual potential of the photoconductor comprising a substrate, a photoconductive layer provided on the substrate, and a protective layer formed directly or via an intermediate layer on the photoconductive layer during the repeated use thereof in the electrophotographic copy making process, and reached the conclusion that carriers with an identical polarity are repeatedly moved by the charging and exposure of the photoconductor in the electrophotographic copy making process and are trapped by the defect levels in the protective layer or the intermediate layer, which are the so-called trap sites, and the elevation of the residual potential is caused by the trapping of the carriers by the trap sites.

The thus trapped carriers are not completely released by the light applied thereto in the last quenching step and are gradually accumulated. As means for forcibly releasing the carriers trapped in the trap sites, a charger capable of charging the photoconductor to a polarity opposite to that of the charges applied to the photoconductor in the first charging step is provided in such a manner that the charger applies such charges to the photoconductor prior to the first charging step, whereby the increase in the residual potential of the photoconductor is minimized even if the copy making process is repeated and an appropriate development potential can be obtained stably for an extended period of time.

With reference to the accompanying drawings, the present invention will now be explained in detail.

Figure 1:
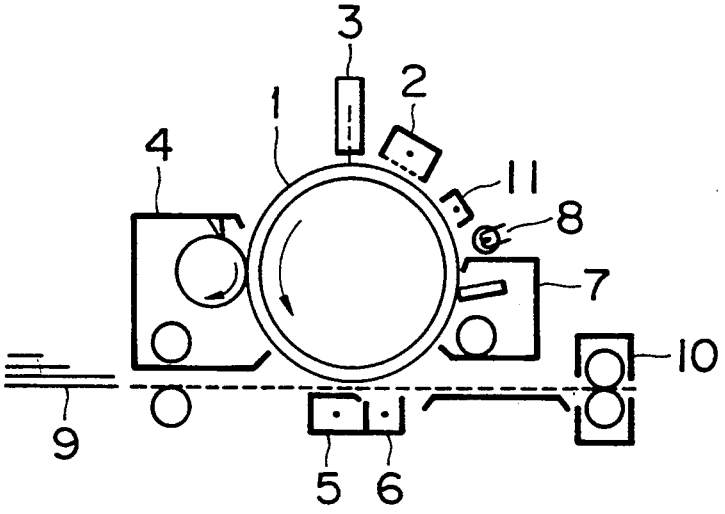
FIG. 1 is a schematic cross-sectional view of an image formation apparatus according to the present invention.

FIG. 1 is a schematic cross-sectional view of an example of an electrophotographic image formation apparatus according to the present invention. In FIG. 1, reference numeral 11 indicates a charger for applying charges with a polarity opposite to that of charges applied in the first charging step, which is hereinafter referred to an opposite-polarity charger 11. As such an opposite polarity charger, a corotron type charger or a scorotron charger, which is conventionally used as a charger in the first charging step, can be employed. The charging method for the opposite-polarity charger 11 may be D.C. charging with a polarity opposite to that of the first charging, or A.C. charging with a modification so as to have a polarity opposite to that of the first charging.

Figure 10:
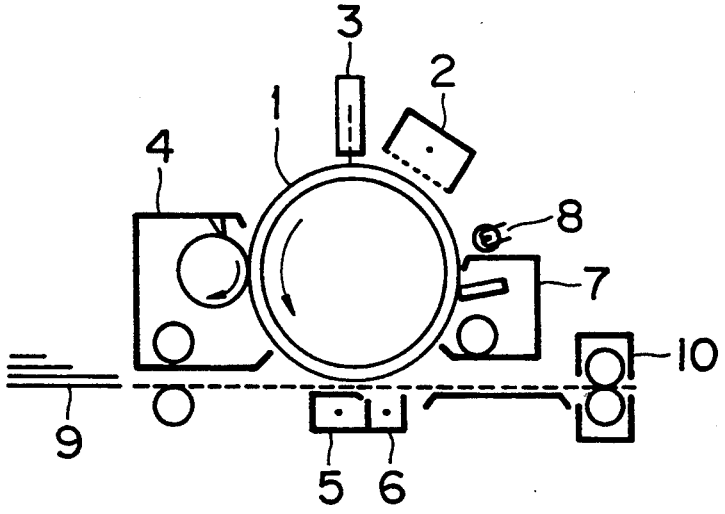
FIG. 10 PRIOR ART
FIG. 10 is a schematic cross-sectional view of a representative example of an electrophotographic image formation apparatus.

Reference numerals 1 to 10 respectively indicate the same units as those with the same reference numerals in FIG. 10.

Figure 2:
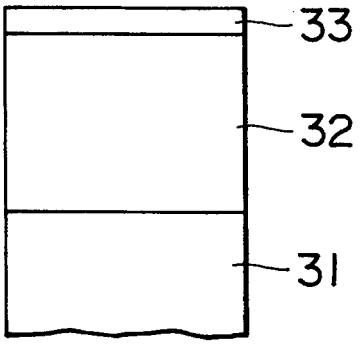
FIG. 2 is a schematic cross-sectional view of a first example of an electrophotographic photoconductor for use in an image formation apparatus according to the present invention.

FIG. 2 is a schematic cross-sectional view of a first example of an electrophotographic photoconductor for use in the above-mentioned electrophotographic image formation apparatus shown in FIG. 1.

This electrophotographic photoconductor comprises an electroconductive support 31, a photoconductive layer 32 provided on the electroconductive support 31, and a protective layer 33 overlaid on the photoconductive layer 32.

Figure 3:
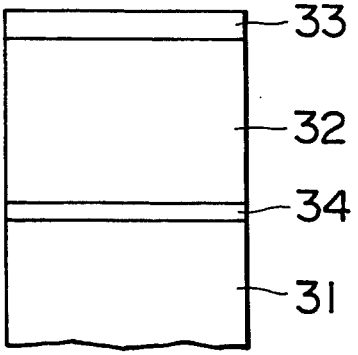
FIG. 3 is a schematic cross-sectional view of a second example of an electrophotographic photoconductor for use in an image formation apparatus according to the present invention.

FIG. 3 is a schematic cross-sectional view of a second example of an electrophotographic photoconductor for use in the electrophotographic image formation apparatus shown in FIG. 1, which comprises an electroconductive support 31, an undercoat layer 34 provided on the electroconductive support 31, a photoconductive layer 32 overlaid on the undercoat layer 34, and a protective layer 33 overlaid on the photo-conductive layer 32.

Figure 4:
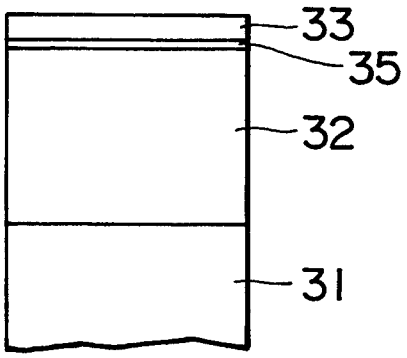
FIG. 4 is a schematic cross-sectional view of a third example of an electrophotographic photoconductor for use in an image formation apparatus according to the present invention.

FIG. 4 is a schematic cross-sectional view of a third example of an electrophotographic photoconductor for use in the electrophotographic image formation apparatus shown in FIG. 1, which is the same as the electrophotographic photoconductor shown in FIG. 2 except that an intermediate layer 35 is interposed between the photoconductive layer 32 and the protective layer 33.

Figure 5:
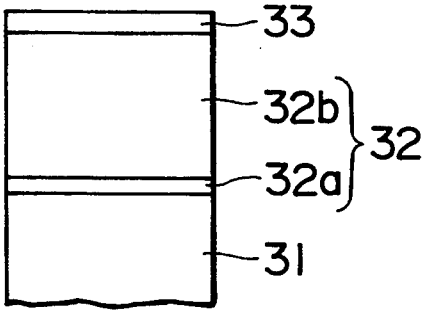
FIG. 5 is a schematic cross-sectional view of a fourth example of an electrophotographic photoconductor for use in an image formation apparatus according to the present invention.

FIG. 5 is a schematic cross-sectional view of a third example of an electrophotographic photoconductor for use in the electrophotographic image formation apparatus shown in FIG. 1, which is the same as the electrophotographic photoconductor shown in FIG. 2 except that the photo-conductive layer 32 is composed of a charge generation layer (CGL) 32*a* and a charge transportation layer (CTL) 32*b* which are overlaid. This electrophotographic photoconductor is of a function-separated type.

Figure 6:
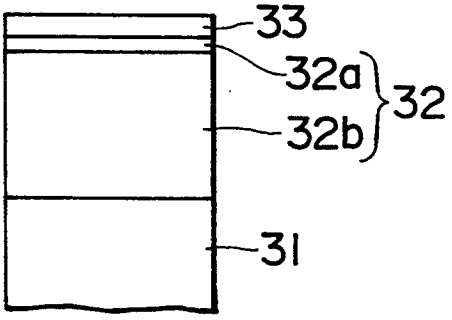
FIG. 6 is a schematic cross-sectional view of a fifth example of an electrophotographic photoconductor for use in an image formation apparatus according to the present invention.

FIG. 6 is a schematic cross-sectional view of a fourth example of an electrophotographic photoconductor for use in the electrophotographic image formation apparatus shown in FIG. 1, which is the same as the electrophotographic photoconductor shown in FIG. 5 except that the overlaying order of the charge generation layer (CGL) 32*a* and the charge transportation layer (CTL) 32*b* is reversed.

It is required that the electrophotographic photoconductor for use in the present invention at least comprise the electroconductive support 31, the photoconductive layer 32 provided on the electroconductive support 31, and the protective layer 33 overlaid on the photoconductive layer 32. Other layers may be optionally further included, and the kind and type of the photoconductive layer 32 may be changed, and the combination of such layers may also be changed.

As the electroconductive support of the electrophotographic photoconductor for use in the present invention, an electroconductive material, an insulating material which has been treated so as to be made electroconductive, metals such as Al, Fe, Cu and Au, and alloys thereof, composite materials composed of an insulating substrate made of, for instance, polyester, polycarbonate, polyimide, or glass, and an electroconductive film provided on the insulating substrate, which electroconductive film is made of a metal such as Al, Ag or Aug, or a metal oxide such as $In_2O_3$, or $SnO_2$, paper treated so as to be made electroconductive. There is no particular limitation on the shape of the electroconductive support. The electroconductive support may be either in the shape of a drum or in the shape of a belt.

The undercoat layer which is interposed between the electroconductive support and the photoconductive layer is provided in order to improve the photosensitive characteristics of the photoconductive layer and the adhesiveness of the photoconductive layer to the electroconductive support. As the materials for the undercoat layer, inorganic materials such as SiO, $Al_2O_3$, a silane coupling agent, a titanium coupling agent, and a chromium coupling agent; binder agents having excellent adhesiveness such as polyamide resin, alcohol-soluble polyamide resin, water-soluble polyvinyl butyral, polyvinyl butyral, and PVA; and the above-mentioned binder agents having excellent adhesiveness in which ZnO, $TiO_2$, or ZnS is dispersed, can be employed.

When the undercoat layer is formed by use of the above-mentioned inorganic materials, the sputtering method, and evaporation method are employed for the provision of the undercoat layer; and when the undercoat layer is formed by use of any of the above-mentioned organic materials, the conventional coating method is employed for the provision of the undercoat layer.

It is preferable that the thickness of the undercoat layer be 5 $\mu$m or less.

The photoconductive layer which may be a Se-based photoconductive layer or an organic photoconductive layer and is directly or via the undercoat layer on the electroconductive support can be formed either in a single layer type or in a function-separated type.

An organic photoconductive layer will now be explained.

Examples of the single-layer type organic photoconductive layer are layers of photoconductive powder such as pigment-sensitized zinc oxide, titanium oxide, and zinc sulfide powders, amorphous silicon powder, squaric salt pigments, phthalocyanine pigments, and azo pigments, when necessary, with the addition of a binder resin and/or an electron donor compound thereto, which are formed by coating; and a layer of a composition of a eutectic complex formed from a pyrylium dye and a bisphenol A based polycarbonate, to which an electron donor is added.

It is preferable that the thickness of the single-layer photoconductive layer be in the range of 5 to 30 μm.

An example of the function-separated type photoconductive layer comprises a charge generation layer (CGL) and a charge transport layer (CTL) which is overlaid on the charge generation layer.

The charge generation layer (CGL) which generates charges for latent electrostatic images and separate them by being exposed to a light image is composed of finely-divided particles of an inorganic photoconductive material such as crystalline selenium or arsenic selenide, or an organic dye or pigment, which are dispersed or dissolved in a binder agent.

Specific examples of the organic charge generating material for use in the charge generation layer are as follows: organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment having a porphyrin skeleton, an azulenium salt pigment, a squaric salt pigment, an azo pigment having a carbazole skeleton (Japanese Laid-Open Patent Application 53-95033), an azo pigment having a styrylstilbene skeleton (Japanese Laid-Open Patent Application 53-138229), an azo pigment having a triphenylamine skeleton (Japanese Laid-Open Patent Application 53-132347), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), and an azo pigment having a distyryl carbazole skeleton (Japanese Laid-Open Patent Application 54-17734), and a triazo pigment having a carbazole skeleton (Japanese Laid-Open Patent Applications 57-195767 and 57-195768); a phthalocyanine pigment such as C.I. Pigment Blue 16 (C.I. 74100); indigo pigments such as C.I. Vat Brown 5 (C.I. 73410) and C.I. Vat Dye (C.I. 73030); perylene pigments such as Algol Scarlet B and Indanthrene Scarlet R (made by Bayer Co., Ltd.); a squaric pigment.

These charge generating materials can be used alone or in combination. It is preferable that the amount of a binder agent be in the range of 0 to 100 parts by weight, more preferably in the range of 0 to 50 parts by weight, to 100 parts by weight of the charge generating material.

Examples of a binder resin employed in combination with the above-mentioned organic dyes and pigments are adhesive and insulating resins, for example, condensation polymerization resins such as polyamide, polyurethane, polyester, epoxy resin, polycarbonate, and polyether; and polymers and copolymers such as polystyrene, polyacrylate, polymethacrylate, poly-N-vinylcarbazole, polyvinyl butyral, styrene—butadiene copolymer, and styrene—acrylonitrile copolymer.

The charge generation layer can be formed by dispersing the charge generating material, when necessary together with a binder resin, in a solvent such as tetrahydrofuran, cyclohexanone, dioxane, or dichloroethane, in a ball mill, attritor, or sandmill, to prepare a dispersion liquid, appropriately diluting the dispersion liquid, and coating the diluted dispersion liquid. The coating ,can be carried out by the immersion coating method, the spray coating method, a roller coating method.

It is preferable that the thickness of the charge generation layer be in the range of about 0.01 to 5 μm, more preferably in the range of 0.1 to 2 μm.

When the fine particles of crystalline selenium or arsenic selenide are used as the charge generating material in the present invention, such charge generating material is used in combination with an electron donor material such as an electron donor adhesive agent and/or an electron donor organic compound.

Examples of such an electron donor material are nitrogen-containing compounds and derivatives thereof, such as polyvinylcarbazole, and derivatives thereof (for example, polyvinylcarbazole derivatives with a substituent such as a halogen atom such as chlorine and bromine, methyl group, and amino group at the carbazole skeleton), polyvinyl pyrene, oxadiazole, pyrazoline, hydrazone, diallyl methane, α-phenylstilbene, and triphenylamine compounds.

It is preferable that the amount of the above-mentioned inorganic charge generating material be in the range of 30 wt. % to 90 wt. % of the entire weight of the charge generation layer. Furthermore, it is preferable that the thickness of the charge generation layer using the inorganic charge generating material be in the range of about 0.2 to 5 μm.

The charge transport layer (CTL) retains charged charges, transports the charges generated and separated in the charge generation layer (CGL) by being exposed to light images, and combines the charged charges and the charges generated and separated in the charge generation layer (CGL). The charge transport layer (CTL) is required to have high electric resistance in order to retain the charged charges. The charge transport layer (CTL) is also required to have a small dielectric constant and excellent charge mobility in order to obtain high surface potential by the retained charges.

The charge transport layer (CTL) comprises a charge generating material, and a binder agent when necessary in order to satisfy the above-mentioned requirements. The charge transport layer (CTL) can be formed by dissolving or dispersing the above-mentioned components in an appropriate solvent to prepare a coating liquid for the formation of the charge transport layer (CTL), applying the coating liquid, for instance, to the charge generation layer (CGL), and drying the applied coating liquid.

Examples of a positive hole transporting material for use in the charge transport layer are electron donor materials such as poly-N-vinylcarbazole and derivatives thereof, poly-γ-carbazolylethylglutamate and derivatives thereof, pyrene—formaldehyde condensate and derivatives thereof, polyvinyl pyrene, polyvinyl phenanthrene, oxazole derivatives, oxadiazole derivatives, imidazole derivatives, triphenyl-(4-dibenzylamionophenyl)propane, styrylanthracene, styrylpyrazoline, phenyl hydrazones, and α-phenylstilbene derivatives.

Examples of an electron transporting material for use in the charge transport layer (CTL) are electron acceptor materials such as chloroanil, bromoanil, tetracyanoethylene, tetracyanoquinone dimethane, 2,4,7-trinitro-9-fluorenone,2,4,5,7-teranitro-9-fluorenone, 2,4,5,7-tetranitroxanthone, 2,4,8-trinitrothioxanthone, 2,6,8-trinitro-4H-indeno(1,2-b)thiophene-4-on, and 1,3,7-trinitrodibenzothiophene-5,5-dioxide.

These charge transporting materials can be used alone and in combination.

Examples of the binder resin that can be used in the charge transport layer, when necessary, are thermoplastic resins and thermosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyacrylate resin, polyvinyl butyral, polyvinyl formal, polyvinyltoluene, poly-N-vinylcarbazole, acrylic resin, silicone resin, epoxy resin, melamine resin, urethane resin, phenolic resin, and alkyd resin.

Examples of a solvent that can be used in the formation of the charge transport layer are tetrahydrofuran, dioxane, toluene, monochlorobenzene, dichloroethane, and methylene chloride.

It is preferable that the thickness of the charge transport layer be in the range of about 5 to 100 μm. A plasticizer and a leveling agent may be added to the charge transport layer.

Examples of the plasticizer for use in the charge transport layer are conventional plasticizers for use in resins in general use, such as dibutylphthalate and dioctylphthalate. It is preferable that such a plasticizer be employed in an amount of 0 to 30 parts by weight to 100 parts by weight of the binder resin employed in the charge transport layer.

Examples of the leveling agent for use in the charge transport layer are silicone oils such as dimethyl silicone oil and methylphenyl silicone oil. It is preferable that such a leveling agent be employed in an amount of 0 to 1 parts by weight to 100 parts by weight of the binder resin employed in the charge transport layer.

The charge generation layer (CGL) and the charge transport layer (CTL) may be overlaid in any order on the electroconductive support. In other words, the charge transport layer (CTL) may be overlaid on the charge generation layer (CGL), or the charge generation layer (CGL) may be overlaid on the charge transport layer (CTL).

The intermediate layer interposed between the organic photoconductive layer and the protective layer for the organic photoconductive layer can be provided by depositing, sputtering, or by conducting anodic oxidation of an inorganic material such as SiO or $Al_2O_3$, or by coating polyamide resin (Japanese Laid-Open Patent Application 58-30757, and Japanese Laid-Open Patent Application 58-98739), an alcohol-soluble nylon resin (Japanese Laid-Open Patent Application 60-196766), a water-soluble polyvinyl alcohol resin (Japanese Laid-Open Patent Application 60-232553), polyvinyl butyral resin (Japanese Laid-Open Patent Application 58-106549), or polyvinyl alcohol.

Pigment particles such as ZnO, $TiO_2$, and ZnS may be dispersed in the intermediate layer composed of any of the above-mentioned resins.

Furthermore, an intermediate layer made of a silane coupling agent, a titanium coupling agent, or a chromium coupling agent can also be employed.

It is preferable that the thickness of the intermediate layer be not more than 5 μm.

Representative examples of the protective layer, which is provided directly or via the intermediate layer on the photoconductive layer in order to improve the mechanical durability of the photoconductive layer, are a protective layer comprising a resin film as mentioned previously and a protective layer composed of a hard carbon film or a hard film comprising carbon as the main component.

As protective layers comprising a resin film, protective layers of a single resin layer type made of polystyrene, polyamide, polyester, or polycarbonate, have been proposed in Japanese Patent Publication 38-015466 and Japanese Patent Publication 38-020697. Furthermore, a protective layer comprising a urethane resin with the electric resistivity thereof being reduced is disclosed in Japanese Patent Publication 52-024414, and a protective layer comprising a urethane resin with the electric resistivity thereof being reduced by dispersing $SnO_2$ or antimony-doped $SnO_2$powder in the urethane resin, and a protective layer comprising an organic polymeric compound with the resistivity thereof being reduced by adding thereto an organic material or an inorganic material which serves as a conductivity controlling agent are proposed in Japanese Laid-Open Patent Applications 57-128344, 54-121044 and 59-223442.

Specific examples of the organic material serving as conductivity controlling agent are metallocene compounds, and specific examples of the inorganic material serving as conductivity controlling agent are finely-divided particles of Au, Ag, Ni and Al, and finely-divided metal oxide particles of zinc oxide, titanium oxide, tin oxide, indium oxide, antimony-oxide-containing tin oxide, and tin-oxide-containing indium oxide.

It is preferable that the particle size of the above-mentioned conductivity controlling agents be in the range of 0.05 to 0.3 μm, and the amount thereof be in the range of 20 to 80 parts by weight to 100 parts by weight of the binder resin employed in the protective layer.

Examples of a binder resin to be used with the above conductivity controlling agents are conventional commercially available resins such as silicone resin, polyurethane resin, acrylic resin, polyester resin, polycarbonate resin, styrene resin, and epoxy resin.

The thickness of the protective layer is generally in the range of 0.1 to 10 μm, preferably in the range of 2 to 7 μm.

The protective layer consisting of carbon or comprising carbon as the main component is a thin film which is transparent in the infrared light region or in the visible light region, preferably with the carbon thereof having C—C bonds similar to diamond having $SP^3$ orbit, the Vickers' hardness (Knoop hardness) thereof being in the range of 100 to 3,000 kg/mm$^2$, the specific resistance thereof being $1\times10^7$ to $1\times10^{13}\Omega$.cm, and the optical energy band width (Eg) thereof being 1.0 eV or more.

Such a carbon film can be formed from hydrocarbon gases (methane, ethane, ethylene, and acetylene gases) as the main components, a carrier gas such as $H_2$, or Ar, and additive gases such as $NH_3$, $PH_3$, $NF_3$, $B_2H_6$, and $CO_2$, by subjecting these gases to the plasma CVD method, the glow discharge decomposition method, or the light CVD method, or by the sputtering method, for instance, by using graphite as a target. There are no particular limitations on the adoption of any of the above-mentioned methods for forming the carbon film. However, it is preferable to employ a plasma method provided with sputtering effects for forming a thin film of carbon or a thin film comprising carbon as the main component, which is disclosed in Japanese Laid-Open Patent Application 58-49609.

In the method of forming a protective layer consisting of carbon or comprising carbon as the main component by using a plasma CVD method, it is unnecessary to heat a substrate for the protective layer, and the protective layer can be formed at about 150° C. or temperatures lower than 150° C., so that there are no problems even when a protective layer is formed on an organic photoconductive layer with low resistance to heat.

The thickness of the protective layer can be adjusted by controlling the film formation time as desired. It is preferable that the protective layer consisting of carbon or comprising carbon as the main component have a thickness in the range of 100 Å to 10 μm, more preferably in the range of 1000 Å to 5 μm.

Additives such as a halogen atom such as fluorine, hydrogen atom, oxygen atom, phosphorus atom, and boron atom, can be added to the protective layer, when necessary in order to improve the mechanical, electrical and optical properties thereof. The concentration of such an additive may be either uniform or gradient in the direction of the thickness of the protective layer.

It is not always necessary that the protective layer be a single layer, but a protective layer of a multiple layered type, for instance, in accordance with the composition and the use of additives, can also be employed.

The intermediate layer which is interposed between the photoconductive layer and the protective layer has the functions of (1) improving the adhesion between the protective layer and the photo-conductive layer, (2) retaining the charges generated by the application of electric charges to the photoconductor at the interface between the protective layer and the photoconductive layer to prevent the injection of the charges from the protective layer to the photoconductive layer, thereby preventing the reduction of the charged potential of the photoconductive layer by the charge injection, and (3) protecting the photoconductive layer when providing the protective layer on the photoconductive layer.

The protective layer having the above-mentioned functions can be prepared from a variety of organic polymeric compounds such as epoxy resin, polyester resin, polyamide resin, polystyrene resin, polyvinylidene chloride resin, polyvinyl acetate resin, polyvinyl chloride, acrylic resin, silicone resin, and fluorine plastics; silane coupling agents such as trimethyl monomthoxysilane, γ-glycidoxypropyltrimethoxysilane, and γ-methacryloxy-propyltrimethoxysilane; metal alkoxides such as titanium tetrabutoxide, aluminum tripropoxide, and zirconium tetrabutoxide; and metal acetylacetone complexes such as titanium acetylacetonate, and zirconium acetylacetonate.

It is preferable that the thickness of the intermediate layer be 10 μm or less, more preferably 1 μm or less.

The features of this invention will become apparent in the course of the following description of exemplary embodiments, which are given for illustration of the invention and are not intended to be limiting thereof.

PHOTOCONDUCTOR FABRICATION EXAMPLE 1

[Formation of Photoconductive Layer]

An electroconductive support made of an aluminum alloy in the shape of a cylinder, with an outer diameter of 80 mm and a length of 340 mm, hereinafter referred to as a drum-shaped electroconductive support, was cleaned and placed in a vacuum deposition apparatus.

With the degree of vacuum in the vacuum deposition temperature set at $1\times10^{-5}$ torr or less, the temperature of the drum-shaped electroconductive support was increased to 210° C. and maintained at 210° C. while it was rotated.

An $As_2Se_3$ alloy serving as a photoconductive material placed in an evaporation source was heated and deposited on the surface of the drum-shaped electroconductive support, whereby a photoconductive layer with a thickness of 60 μm was formed on the drum-shaped electroconductive support.

[Formation of Intermediate Layer]

A ligroin solution of a commercially available silicone resin (Trademark "AY42-441" made by Toray Silicone Co., Ltd.) was coated on the surface of the photoconductive layer formed on the drum-shaped electroconducive support and dried, whereby an intermediate layer with a thickness of 0.2 μm was formed.

[Formation of Protective Layer]

A mixture of the following components with the following formulation was dispersed in an appropriate amount of a mixed solvent composed of acetone, cellosolve acetate and methyl iso-butyl ketone with a mixing ratio of 20:7:3 in terms of parts by weight in a ball mill for 100 hours to prepare a dispersion:

| | Parts by Weight |
|---|---|
| Acrylpolyol (styrene-methylmethacrylate-methacrylic acid 2-hydroxy ethyl copolymer) | 15 |
| Tin oxide powder | 60 |
| 2,6-di-t-butyl-p-cresol | 0.2 |

To this dispersion, 5 parts by weight of a polyisocyanate-based curing agent were added, whereby a protective layer formation liquid was prepared.

The thus prepared protective layer formation liquid was coated on the surface of the intermediate layer by spray coating, and was dried at 120° C. for 1 hour, whereby a protective layer with a thickness of about 5 μm was provided on the intermediate layer. Thus, Electrophotographic Photoconductor No. 1 for use in the present invention was fabricated.

COMPARATIVE PHOTOCONDUCTOR FABRICATION EXAMPLE 1

The procedure for the fabrication of Photographic Photoconductor No. 1 in Photoconductor Fabrication Example 1 was repeated except that the intermediate layer and the protective layer provided in Photographic Photoconductor No. 1 were not provided, whereby Comparative Photoconductor-A, was fabricated.

PHOTOCONDUCTOR FABRICATION EXAMPLE 2

[Formation of Charge Transport Layer (CTL)]

The following components were mixed with the following formulation, whereby a charge transport layer formation liquid was prepared:

| | Parts by Weight |
|---|---|
| 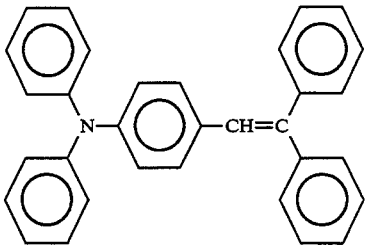 | 10 |
| Polycarbonate (Trademark "Panlite C-1400" made by Teijin Limited) | 10 |
| Tetrahydrofuran | 80 |
| Silicone oil (Trademark "KF50" made by Shin-etsu Chemical Co., Ltd.) | 0.001 |

The thus prepared charge transport layer formation liquid was coated on the outer surface of an electroconductive support made of an aluminum alloy in the shape of a cylinder, with an outer diameter of 80 mm and a length of 340 mm (hereinafter referred to as the drum-shaped electroconductive support), whereby a charge transport layer with a thickness of 20 μm when dried was formed on the drum-shaped electroconductive support.

[Formation of Charge Generation Layer (CGL)]

A mixture of the following components with the following formulation was dispersed in a ball mill for 48 hours:

| | Parts by Weight |
|---|---|
| Polyamide resin (Trademark "CM8000" made by Toray Industries, Inc.) | 1 |
| Methanol | 99 |

The thus prepared intermediate layer formation liquid was coated on the above charge generation layer by spray coating and dried, whereby an intermediate layer with a thickness of 0.2 μm was formed on the charge generation layer.

[Formation of Protective Layer]

The same protective layer formation liquid as in Example 1 was prepared and coated on the surface of the intermediate layer by spray coating, and was dried at 120° C. for 1 hour, whereby a protective layer with a thickness of about 5 μm was provided on the intermediate layer.

Thus, Electrophotographic Photoconductor No. 2 for use in the present invention was fabricated.

COMPARATIVE PHOTOCONDUCTOR FABRICATION EXAMPLE 2

The procedure for the fabrication of Photographic Photoconductor No. 2 in Photoconductor Fabrication Example 2 was repeated except that the intermediate layer and the protective layer provided in Photographic Photoconductor No. 2 were not provided, whereby Comparative Photoconductor-B Was fabricated.

PHOTOCONDUCTOR FABRICATION

| | Parts by Weight |
|---|---|
| 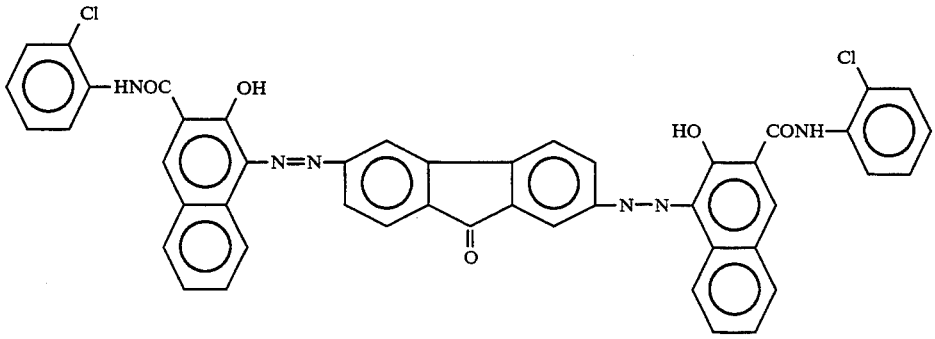 | 25 |
| Cyclohexanone | 300 |

To the above mixture, 30 parts by weight of a commercially available polystyrene (Trademark "HRM" made by Denki Kagaku Co., Ltd.) were added. This mixture was then diluted with 400 parts by weight of a mixed solvent of cyclohexanone and methyl ethyl ketone with a mixing ratio of 1:1 in terms of parts by weight to prepare a dispersion liquid.

This dispersion liquid was coated on the charge transport layer by spray coating, whereby a charge generation layer (CGL) with a thickness of about 1 μm when dried was formed on the charge transport layer (CTL).

[Formation of Intermediate Layer]

The following components were mixed with the following formulation, whereby an intermediate layer formation liquid was prepared:

EXAMPLE 3

[Formation of Undercoat Layer]

The following components were mixed with the following formulation, whereby an undercoat layer formation liquid was prepared:

| | Parts by Weight |
|---|---|
| $TiO_2$ (Trademark "Tipaque" made by Ishihara Sangyo Kaisha, Ltd.) | 1 |
| Polyamide resin (Trademark "CM8000" made by Toray Industries, Inc.) | 1 |
| Methanol | 25 |

The thus prepared undercoat layer formation liquid was coated on the outer surface of an electroconductive support made of aluminum in the shape of a cylinder, with an outer diameter of 80 mm and a length of 340 mm (hereinafter referred to as the drum-shaped electroconductive support), whereby an undercoat layer with a thickness of about 2 μm when dried was formed on the drum-shaped electroconductive support.

Formation of Charge Generation Layer (CGL)]

A mixture of the following components with the following formulation was dispersed in a ball mill for 72 hours:

| | Parts by Weight |
|---|---|
| 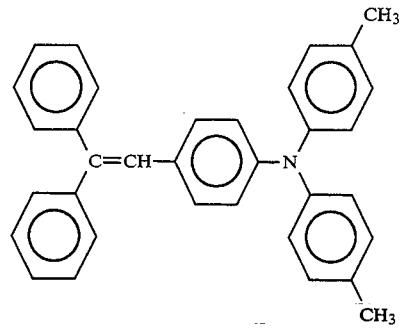 | 10 |
| 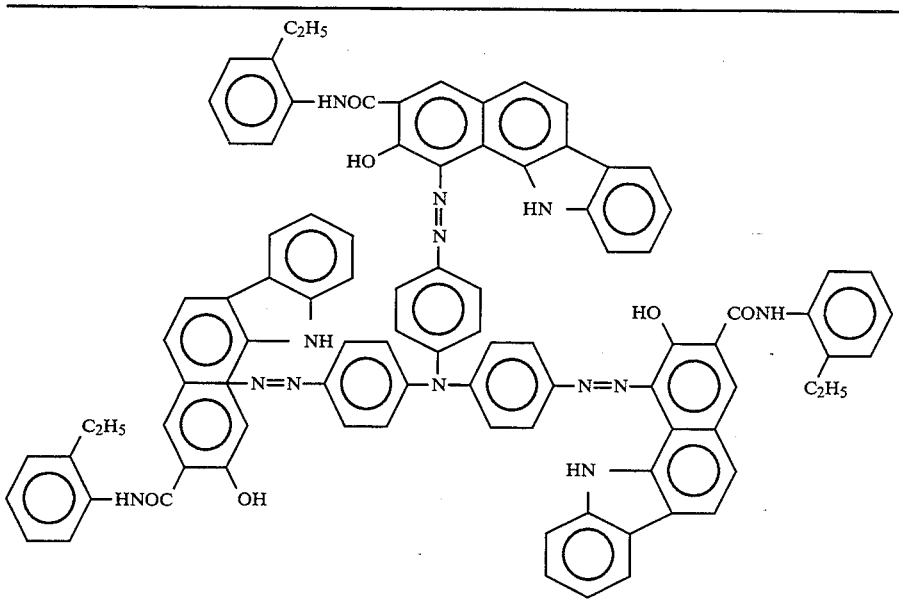 | 30 |
| Polyester resin (Trademark "Vylon 200" made by Toyobo Co., Ltd.) | 12 |
| Cyclohexanone | 360 |

The above dispersion liquid was diluted with 500 parts by weight of a mixed solvent composed of cyclohexanone and methyl ethyl ketone with a mixing ratio of 1:1 in terms of parts by weight, whereby a charge generation layer formation liquid was prepared.

The thus prepared charge generation layer formation liquid was coated on the undercoat layer by dipping coating and dried at 120° C. for 10 minutes, whereby a charge generation layer with a thickness of about 0.15 μm was formed on the undercoat layer.

[Formation of Charge Transport Layer (CTL)]

The following components were mixed with the following formulation, whereby a charge transport layer formation liquid was prepared:

| | |
|---|---|
| Polycarbonate (Trademark "Panlite C-1400" made by Teijin Limited) | 10 |
| Tetrahydrofuran | 80 |
| Silicone oil (Trademark "KF50" made by Shin-etsu Chemical Co., Ltd.) | 0.001 |

The thus prepared charge transport layer formation liquid was coated on the charge generation layer by dipping coating and dried, whereby a charge generation layer with a thickness of about 30 μm was formed on the charge generation layer.

Thus a photoconductive layer composed of the charge generation layer and the charge transport layer was formed on the undercoat layer.

Figure 7:
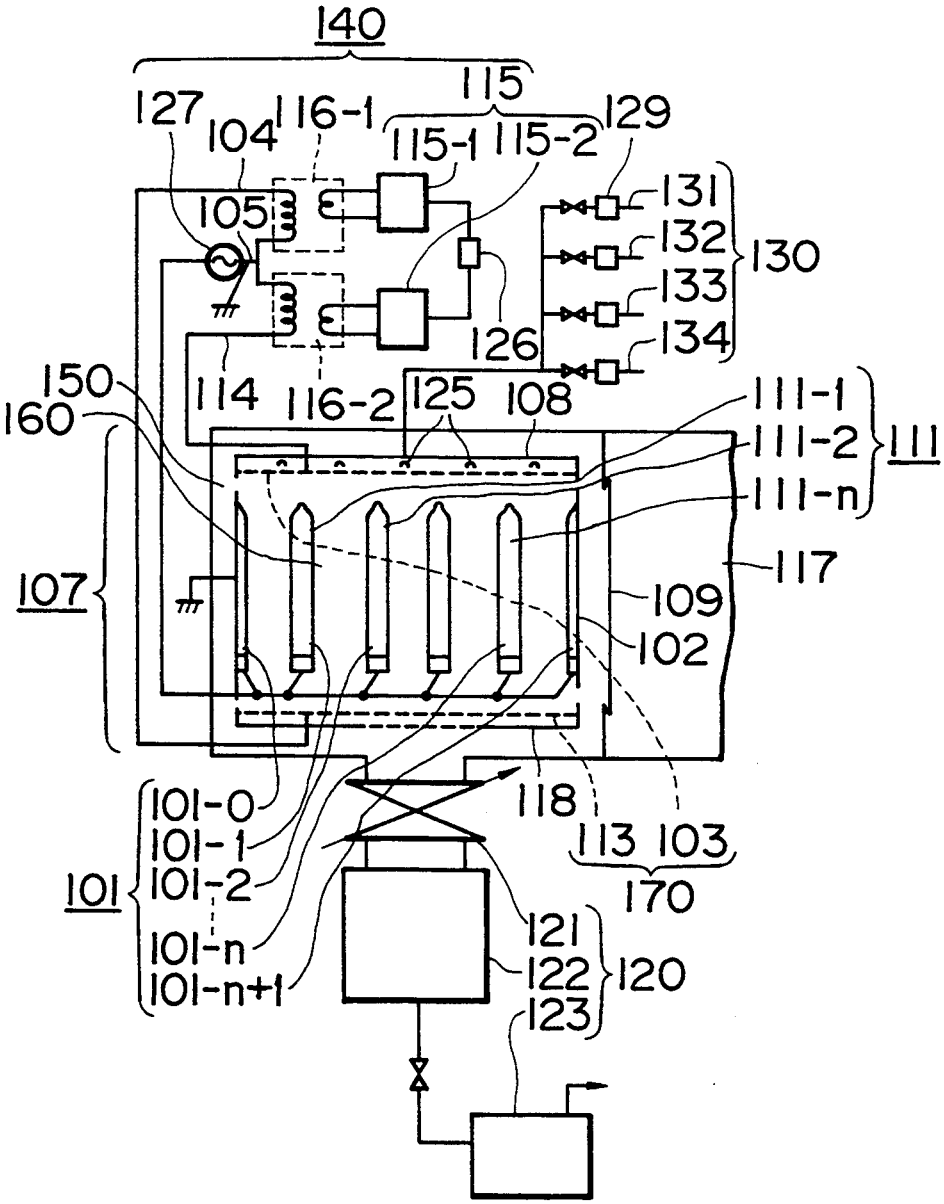
FIG. 7 is a schematic diagram in explanation of a plasma CVD apparatus for forming a protective layer which consists of carbon or comprises carbon as the main component.

The photoconductive layer provided via the undercoat layer on the drum-shaped electroconductive support was placed in a plasma CVD apparatus as shown in FIG. 7 in order to provide a protective layer consisting of carbon or comprising carbon as the main component on the photo-conductive layer.

In FIG. 7, reference numeral 107 indicates a vacuum chamber of the plasma CVD apparatus. The vacuum chamber 107 is divided into a reaction chamber 150 and a preliminary loading and unloading chamber 117. The vacuum chamber 107 is evacuated for producing a vacuum therein by an exhaust system 120 comprising a pressure regulating valve 121, a turbo molecular pump 122, and a rotary pump 123. The degree of vacuum in the vacuum chamber 107 is maintained at a predetermined value.

The reaction chamber 150 is composed of (1) a frame structure member 102, which has a square or hexagonal shape when viewed from the side of a first electrode 103 and a second electrode 113, (2) hoods 108 and 118 for closing the openings at both ends of the frame structure member 102, and (3) a pair of the above-mentioned electrodes 103 and 113, which are the same in shape, and are respectively attached to the hoods 108 and 118. The first and second electrodes 103, 113 are made of a metal mesh, for instance, an aluminum metal mesh.

Reference numeral 130 indicates gas lines through which various gases are introduced into the reaction chamber 150 and which are connected to gas containers for various gases. Each gas is introduced into the reaction chamber 150 through each nozzle 125 via each flow meter 129.

Figure 8:
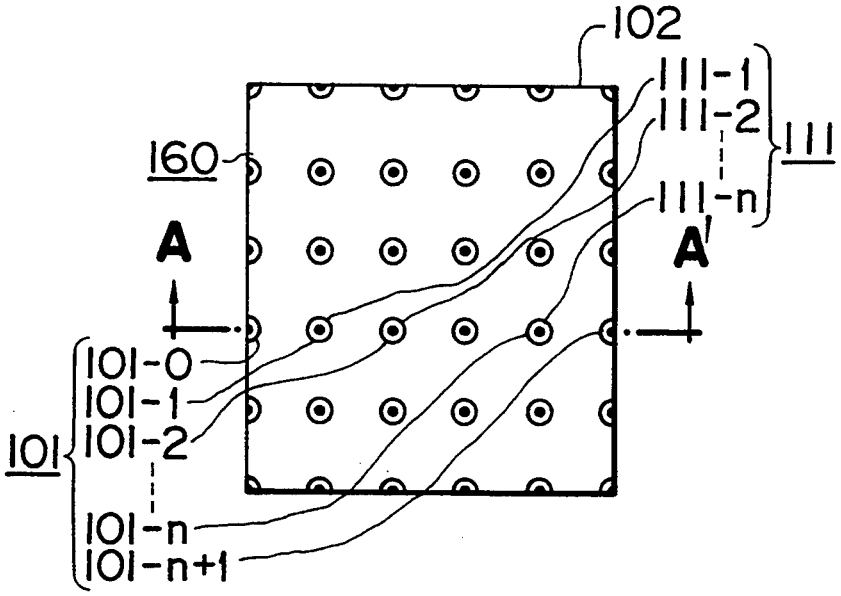
FIG. 8 is a plan view of a frame structure member for use in a plasma CVD apparatus for forming a protective layer which consists of carbon or comprises carbon as the main component.
Figure 9:
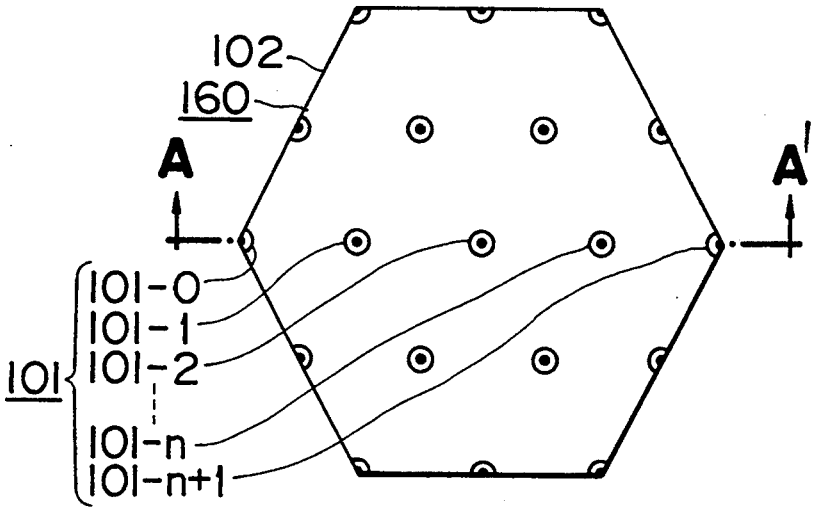
FIG. 9 is a plan view of a frame structure member for use in another plasma CVD apparatus for forming a protective layer which consists of carbon or comprises carbon as the main component.

In the frame structure member 102, the electroconductive supports 101 (101-1, 101-2, . . . , 101-n) are arranged as shown in FIG. 8 and FIG. 9. Reference numerals 101-0 and 101-n+1 indicate dummies for the electroconductive supports 101 since each of these electroconductive supports 101-0, 101-1, 101-2, . . , 101-n, and 101-n+1 serves as a third electrode and the above-mentioned dummy electroconductive supports 101-0 and 101n+1 are necessary to perform uniform deposition for fabricating a uniform protective layer.

The first electrode 103 is provided with a power source 115-2, and the second electrode 113 is provided with a power source 115-1. These electrodes 115 (115-1, 115-2) are for applying a first alternating voltage to the above electrodes 113 and 103. The frequency of the first alternating voltage is 1 to 100 MHz. These power sources 115-1 and 115-2 are respectively connected to matching transformers 116-1 and 116-2. The phase in these matching transformers 116-1 and 116-2 is regulated by a phase regulator 126, and the alternating voltage can be supplied with a relative shift of 180° or 0°. In other words,the output can be performed with a symmetrical phase or with an identical phase. One terminal 104 of the matching transformer 116-1 and one terminal of the matching transformer 116-2 are respectively connected to the second electrode 113, and to the first electrode 103. The other terminals of the matching transformers 116-1 and 116-2 are grounded from a mid-point 105 of an output side of the matching transformers 116-1 and 116-2.

A power source 127 for applying a second alternating voltage across the mid-point 105 and the electroconductive supports 101-0, 101-1, 101-2, . . , 101-n, and 101-n+1 is provided. The frequency of the second alternating voltage is 1 to 500 KHz. The output of the first alternating voltage applied to the first electrode 103 and the second electrode 113 is 0.1 to 1 KW when the frequency is 13.56 MHz. The output of the second alternating voltage applied to the third electrode is about 100 W when the frequency is 150 KHz.

The protective layer consisting of carbon or comprising carbon as the main component was formed under the following conditions:

| | |
|---|---|
| Flow rate of $C_2H_4$: | 100 sccm |
| Flow rate of $H_2$: | 200 sccm |
| Flow rate of $NF_3$: | 50 sccm |
| Reaction pressure: | 0.03 torr |
| Output of First Alternating Voltage: | 100 W 13.5 MHz |
| Bias Voltage (D.C. component) | −20 V |

By adjusting the time period for the formation of protective layer, a protective layer with a thickness of 2.0 μm was provided on the photoconductive layer, whereby Photographic Photoconductor No. 3 for use in the present invention was fabricated.

PHOTOCONDUCTOR FABRICATION EXAMPLE 4

The procedure for the fabrication of Photographic Photoconductor No. 3 was repeated except that the thickness of the protective layer in Photographic Photoconductor No. 3 was increased to 2.5 μm, whereby Photographic Photoconductor No. 4 for use in the present invention was fabricated.

COMPARATIVE PHOTOCONDUCTOR FABRICATION EXAMPLE 3

The procedure for the fabrication of Photographic Photoconductor No. 3 in Photoconductor Fabrication Example 3 was repeated except that the protective layer provided in Photographic Photoconductor No. 3 was not provided, whereby Comparative Photoconductor-C was fabricated.

The thus fabricated Photoconductors No. 1 to No. 4, and Comparative Photoconductors-A, -B, and -C were evaluated with respect to the changes ($\Delta V_1$) in the potential in the exposed portion of the photoconductor, the performance of image reproduction, and the abrasion of the photoconductor while in use, by use of the following image formation apparatus:

EXAMPLE 1

Photoconductor No. 1 fabricated in Photoconductor Fabrication Example 1 and Photoconductor No. 2 fabricated in Photoconductor Fabrication Example 2 were tested by a commercially available copying machine (Trademark "RICOPY-FT6860" made by Ricoh Company, Ltd.) which was modified in such a manner that a D.C. charger for negative charging with an output of −4.2 KV, with the polarity thereof being set opposite to the positive polarity of a first charger for positive charging, was disposed at a step prior to the charging by the first charger.

EXAMPLE 2

Photoconductor No. 1 fabricated in Photoconductor Fabrication Example 1 and Photoconductor No. 2 fabricated in Photoconductor Fabrication Example 2 were tested by a commercially available copying machine (Trademark "RICOPY-FT6860" made by Ricoh Company, Ltd.) which was modified in such a manner that an A.C. charger for negative charging with a D.C. discharge voltage of −300 V, an A.C. discharge voltage of 4.0 KV, and an A.C. frequency of 500 KHz, which was biased with the polarity thereof being set opposite to the positive polarity of the first charger for positive charging, was disposed at a step prior to the charging by the first charger.

COMPARATIVE EXAMPLE 1

Photoconductor No. 1 fabricated in Photoconductor Fabrication Example 1, Photoconductor No. 2 fabricated in Photoconductor Fabrication Example 2, Comparative Photoconductor-A fabricated in Comparative Photoconductor Fabrication Example 1, and Comparative Photoconductor-B fabricated in Comparative Photoconductor Fabrication Example 2 were tested by a commercially available plain paper copying machine (Trademark "RICOPY-FT6860" made by Ricoh Company, Ltd.), in which no opposite polarity charger was provided at a step prior to the charging by the first positive charger.

EXAMPLE 3

Photoconductor No. 3 fabricated in Photoconductor Fabrication Example 3 and Photoconductor No. 4 fabricated in Photoconductor Fabrication Example 4 were tested by a commercially available copying machine (Trademark "IMAGIO 420 V" made by Ricoh Company, Ltd.) which was modified in such a manner that a D.C. charger for positive charging with an output of +4.5 KV, with the polarity thereof being set opposite to the negative polarity of a first charger for negative charging, was disposed at a step prior to the charging by the first charger.

EXAMPLE 4

Photoconductor No. 3 fabricated in Photoconductor Fabrication Example 3 and Photoconductor No. 4 fabricated in Photoconductor Fabrication Example 4 were tested by a commercially available copying machine (Trademark "IMAGIO 420V" made by Ricoh Company, Ltd.) which was modified in such a manner that an A.C. charger for positive charging with a D.C. discharge voltage of +500 V, an A.C. discharge voltage of 4.1 KV, and an A.C. frequency of 500 KHz, which was biased with the polarity thereof being set opposite to the negative polarity of the first charger for negative charging, was disposed at a step prior to the charging by the first charger.

COMPARATIVE EXAMPLE 2

Photoconductor No. 3 fabricated in Photoconductor Fabrication Example 3, Photoconductor No. 4 fabricated in Photoconductor Fabrication Example 4, and Comparative Photoconductor-C fabricated in Comparative Photoconductor Fabrication Example 3 were tested by a commercially available plain paper copying machine (Trademark "IMAGIO 420V" made by Ricoh Company, Ltd.), in which no opposite polarity charger was provided at a step prior to the charging by the first negative charger.

The results of the above evaluations in Examples 1 to 4 and Comparative Examples 1 and 2 are shown in the following Table 1:

TABLE 1

| Image Formation Apparatus | Photo-conductors | Number of Copies Made: 1 | | | 20,000 | | | 50,000 | | | 100,000 | | |
|---|---|---|---|---|---|---|---|---|---|---|---|---|---|
| | | $\Delta V_1$ | Performance of Image Reproduction[1] | Abrasion[2] | $\Delta V_1$ | Performance of Image Reproduction[1] | Abrasion[2] | $\Delta V_1$ | Performance of Image Reproduction[1] | Abrasion[2] | $\Delta V_1$ | Performance of Image Reproduction[1] | Abrasion[2] |
| Ex. 1 | Photoconductor No. 1 | 0 | 5.0 | 0 | 20 | 5.0 | 0 | 25 | 5.0 | D | 25 | 5.0 | 0 |
| | Photoconductor No. 2 | 0 | 5.0 | 0 | 20 | 5.0 | 0 | 20 | 5.0 | 0 | 20 | 5.0 | 0 |
| Ex. 2 | Photoconductor No. 1 | 0 | 5.0 | 0 | 25 | 5.0 | 0 | 30 | 5.0 | 0 | 35 | 5.0 | 0 |
| | Photoconductor No. 2 | 0 | 5.0 | 0 | 20 | 5.0 | 0 | 25 | 5.0 | 0 | 25 | 5.0 | 0 |
| Comp. Ex. 1 | Photoconductor No. 1 | 0 | 5.0 | 0 | 90 | 3.0[3] | 0 | 110 | 2.0[3] | 0 | 120 | 1.0[3] | 0 |
| | Photoconductor No. 2 | 0 | 5.0 | 0 | 80 | 3.0[3] | 0 | 110 | 2.0[3] | 0 | 115 | 1.5[3] | 0 |
| | Comp. Photoconductor-A | 0 | 5.0 | 0 | 0 | 5.0 | 0 | 0 | 4.5 | 0.5 | 5 | 3.0[4] | 1.1 |
| | Comp. Photoconductor-B | 0 | 5.0 | 0 | 200 | 1.0[5] | 1.8 | — | — | — | — | — | — |
| Ex. 3 | Photoconductor No. 3 | 0 | 5.0 | 0 | 20 | 5.0 | 0 | 30 | 5.0 | 0 | 30 | 5.0 | 0 |
| | Photoconductor No. 4 | 0 | 5.0 | 0 | 30 | 5.0 | 0 | 40 | 5.0 | 0 | 40 | 5.0 | 0 |
| Ex. 4 | Photoconductor No. 3 | 0 | 5.0 | 0 | 25 | 5.0 | 0 | 35 | 5.0 | 0 | 35 | 5.0 | 0 |
| | Photoconductor No. 4 | 0 | 5.0 | 0 | 35 | 5.0 | 0 | 50 | 5.0 | 0 | 50 | 5.0 | 0 |
| Comp. Ex. 2 | Photoconductor No. 3 | 0 | 5.0 | 0 | 80 | 3.0[6] | 0 | 120 | 1.0[6] | 0 | 140 | 1.0[6] | 0 |
| | Photoconductor No. 4 | 0 | 5.0 | 0 | 100 | 3.0[6] | 0 | 150 | 1.0[6] | 0 | 180 | 1.0[6] | 0 |
| | Comp. Photoconductor-C | 0 | 5.0 | 0 | 5 | 4.5 | 2.1 | 10 | 3.5[7] | 5.0 | 15 | 2.0[7] | 10.5 |

Numbers 1 to 7 in Table 1 denote as follows:
[1]Quality of the performance of image reproduction with ranks 5.0 (good) to 1.0 (no good).
[2]Unit (μm).
[3]Due to the deposition of toner on the background of images caused by the elevation of the residual potential of the photoconductor.
[4]Due to the formation of striped, abnormal images caused by the scratches formed on the surface of the photoconductor.
[5]Due to the deposition of toner on the background of images and the formation of striped, abnormal images caused by the cracking of the charge generation layer. Further evaluation was discontinued.
[6]Due to the decrease in image density and the formation of blurred line images caused by the elevation of the residual potential of the photoconductor.
[7]Due to the deposition of toner on the background of images caused by the decrease of the charged potential because of the abrasion of the OPC.

The results shown in Table 1 indicate that the image formation apparatus employed in Examples 1, 2, and 3 can sufficiently utilize the characteristics of the photoconductors comprising a photoconductive layer and a protective layer overlaid on the photoconductive layer and also can control the elevation of the residual potential thereof to such an extent that the controlling of the elevation of the residual potential has no adverse effects on the performance of image reproduction. Therefore, it was possible to make 100,000 clear copies continuously by the image formation apparatus employed in Examples 1, 2 and 3.

In contrast, when the image formation apparatus employed in Comparative Examples 1 and 2 were used, the photoconductive layers were not abraded, but the residual potential thereof was conspicuously increased as the number of copies made was increased, and the deterioration of image quality was observed from about 200,000th copy on.

In Comparative Photoconductors A, B, and C, the residual potential thereof was scarcely increased, but the surface of those photoconductors was so easily scratched and abraded while in use that abnormal images were formed soon after starting the image formation process. Thus, these comparative photoconductors did not have sufficient durability for use in practice.

Thus, the image formation apparatus of the present invention is capable of making the best use of the excellent mechanical durability of the photoconductors comprising a photoconductive layer and a protective layer formed thereon, and therefore capable of providing high image quality for an extended period of time.

What is claimed is:

1. An electrophotographic image formation apparatus which comprises a photoconductor comprising a substrate, a photoconductive layer provided on said substrate, and a protective layer formed directly or via an intermediate layer on said photoconductive layer, wherein said apparatus further comprises:

(a) first charging means for performing a first charging by which the surface of said photoconductor is uniformly charged, (b) means for exposing the charged surface of said photoconductor to light images to form latent electrostatic images corresponding to said light images on said photoconductor, (c) means for developing said latent electrostatic images to form toner images, (d) means for transferring said toner images to a transfer sheet, (e) means for cleaning the surface of said photoconductor to remove residual toners therefrom, (f) means for fixing said toner images to said transfer sheet, (g) a quenching lamp for quenching residual charges remaining on a surface of said photoconductor, and (h) second charging means for performing a second charging with a polarity opposite to that of the charge applied by said first charging means to prevent a gradual increase of residual charges in said photoconductor which can result from the use of said protective layer, said second charging means located downstream of said means for cleaning and upstream of said first charging means with respect to a direction of movement of said photoconductor, said second charging means thereby preventing a degradation of image quality which can result from a gradual build up of residual charges.

2. The electrophotographic image formation apparatus as claimed in claim 1, wherein said photo-conductive layer of said photoconductor is an organic photoconductive layer and said protective layer is a thin layer comprising carbon.

3. The electrophotographic image formation apparatus as claimed in claim 1, wherein said second charging means includes an A.C. charger biased so as to be capable of charging said photoconductor with a polarity opposite to that of the charge applied by said first charging means.

4. The electrophotographic image formation apparatus of claim 1, wherein said quenching lamp is disposed downstream of said means for cleaning and upstream of said second charging means with respect to a direction of movement of said photoconductor.

* * * * *

UNITED STATES PATENT AND TRADEMARK OFFICE

CERTIFICATE OF CORRECTION

PATENT NO. : 5,452,061

DATED : SEPTEMBER 19, 1995

INVENTOR(S) : KOJIMA, ET AL.

It is certified that error appears in the above-identified patent and that said Letters Patent is hereby corrected as shown below:

Column 1, line 7, "apparats", should read --apparatus--.

Column 2, line 18, "produces", should read --produce--.

Column 6, line 24, "Al, Ag or Aug,",
should read --Al, Ag or Au,".

Column 11, lines 46-47, "monom-thoxysilane,",
should read --monomthoxysilane--.

Column 15, line 9, "Formation", should read --[Formation--.

Column 17, line 61, "The output", should begin as a new paragraph on line 61.

Column 21, under 50,000 category, under Abrasion$^2$,
"D", should read --0--.

Signed and Sealed this
Seventeenth Day of September, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,452,061

DATED : September 19, 1995

INVENTOR(S) : Kojima, et al

It is certified that error appears in the above-identified patent and that said Letters Patent is hereby corrected as shown below:

Column 11, lines 46-47, "monom-thoxysilane," should read --monomethoxysilane--.

Signed and Sealed this

Third Day of December, 1996

*Attest:*

*Attesting Officer*

BRUCE LEHMAN

*Commissioner of Patents and Trademarks*